US005189244A

United States Patent [19]

Weldon

[11] Patent Number: 5,189,244

[45] Date of Patent: Feb. 23, 1993

[54] METHOD AND APPARATUS FOR SPINNING PROJECTILES FIRED FROM A RAIL GUN

[75] Inventor: William F. Weldon, Austin, Tex.

[73] Assignee: Board of Regents, The University of Texas System, Austin, Tex.

[21] Appl. No.: 396,832

[22] Filed: Aug. 21, 1989

Related U.S. Application Data

[63] Continuation of Ser. No. 275,605, Nov. 23, 1988, abandoned, which is a continuation of Ser. No. 868,547, May 30, 1986, abandoned.

[51] Int. Cl.[5] ..... F41B 6/00

[52] U.S. Cl. ..... 89/8; 124/3

[58] Field of Search ..... 60/202; 89/8; 124/3; 310/10, 11, 12, 13, 14

[56] References Cited

U.S. PATENT DOCUMENTS

| | | | |
|---|---|---|---|
| H123 | 9/1986 | Wright, Jr. | 89/8 |
| 259,817 | 6/1882 | Cheever | 310/14 |
| 1,370,200 | 3/1921 | Fauchon-Villeplee | 124/3 |
| 1,384,769 | 7/1921 | MacLaren | 89/8 |
| 1,421,435 | 7/1922 | Fauchon-Villeplee | 310/13 X |
| 1,985,254 | 12/1934 | Huse | 89/8 X |
| 2,465,351 | 3/1949 | Busignies et al. | 89/6.5 X |
| 2,557,949 | 6/1951 | Deloraine | 89/6.5 |
| 2,603,970 | 7/1952 | Metzler et al. | 89/1.1 X |
| 3,126,789 | 3/1964 | Meyer | 89/8 |
| 3,256,687 | 6/1966 | Janes et al. | 60/202 |
| 4,378,740 | 4/1983 | Schneider | 102/503 |
| 4,449,441 | 5/1984 | McAllister | 89/8 |
| 4,458,577 | 7/1984 | Fisher et al. | 89/8 |
| 4,480,523 | 11/1984 | Young et al. | 89/8 |
| 4,555,972 | 12/1985 | Heyne | 89/8 |
| 4,579,059 | 4/1986 | Flatau | 102/503 |

OTHER PUBLICATIONS

Whelen, Colonel Townsend, Small Arms Design and Ballistics, vol. I. pp. 9–18, 1945.

Hart et al, "Metallic Induction Reaction Engine", AD-A173 323, Nov. 27, 1985, pp. 1–23.

Burgess et al, "The Electromagnetic θ Gun and Tubular Projectiles", IEEE Transactions Magnetics, vol. 18, No. 1, Jan. 1982, 46–59.

*Primary Examiner*—Stephen C. Bentley

*Attorney, Agent, or Firm*—Arnold, White & Durkee

[57] ABSTRACT

A method and apparatus for imparting a spin to a projectile fired from a railgun. A projectile which is rotatable within the barrel of the railgun, and which includes a conductive element, is caused to pass through a magnetic field, causing the projectile to rotate. Preferably, the magnetic field will be established by a solenoidal magnet which is coaxial with the path of the projectile.

31 Claims, 2 Drawing Sheets

METHOD AND APPARATUS FOR SPINNING PROJECTILES FIRED FROM A RAIL GUN

This application is a continuation of application Ser. No. 275,605, filed Nov. 23, 1988, now abandoned, which is a continuation of application Ser. No. 868,547, filed May 30, 1986, now abandoned.

BACKGROUND OF THE INVENTION

The present invention relates generally to railguns, and more specifically relates to methods and apparatus for spinning projectiles fired from railguns.

Railguns have been utilized to fire projectiles at high velocities. Railguns utilize a pair of conductors extending in spaced relation along a barrel through which the projectile is accelerated. An electrical potential is applied between the two conductors, passing a high current through an armature on the projectile. The projectile is accelerated down the barrel and out the muzzle of the railgun.

In conventional projectile weaponry, such as fire arms and artillery, it has been known that significant benefits to weapon performance are achieved by causing the fired projectile to spin about its longitudinal axis. Such spin increases the stability of the projectile in flight, causing the projectile to travel more predictably and accurately towards its target. In conventional weapon technology, a spin is mechanically induced into a projectile as it traverses the weapon barrel. To induce the spin, the barrel of the weapon includes rifling, a plurality of helical grooves extending down the barrel. As the projectile is fired out the barrel, the grooves cut into the projectile casing and induce a spin in the projectile. Because the pitch of the rifling is fixed, the rate of spin is directly related to the velocity of the projectile within the barrel.

Prior to the present invention, there has been no means by which to impart a spin to a projectile fired from a railgun. Accordingly, the present invention provides a new method and apparatus for imparting a spin to a projectile fired from a railgun and for controlling the rate of the spin as the projectile travels within the barrel of the railgun independently of the velocity of the projectile.

SUMMARY OF THE INVENTION

The present invention includes a railgun which is cooperatively conformed with a projectile such that the projectile may both be propelled from the barrel of the railgun and be rotated within the barrel. In a particularly preferred embodiment, the railgun will be a coaxial railgun and the projectile will be a generally tubular projectile which is free to rotate axially relative to the longitudinal axis of the railgun and the projectile. In this particularly preferred embodiment, one or more solenoidal magnet coils will be oriented exterior to the barrel of the railgun coaxially with the barrel. During the launch cycle of the projectile, an electrical current will be passed through the coil establishing a magnetic flux field intersecting the projectile path through the barrel. The projectile includes at least one conductive element in electrical contact with both conductors of the railgun barrel. Also in this particularly preferred embodiment, wherein the projectile is a tubular projectile, the conductive element is situated in the armature of the projectile. This armature preferably includes either a conductive ring or a plurality of radially spaced conductive portions.

In operation of this particularly preferred embodiment, the solenoidal magnet is utilized to establish a magnetic field during the launch period of the projectile. As the speed voltage causes the projectile to traverse the barrel and thereby pass through the magnetic field, the current flowing radially in the conductive armature of the projectile interacts with the axial magnetic field from the solenoid to produce tangential force on the armature, causing rotation of the projectile. As this rotation, or "spin", is directly related to the strength of the magnetic field applied by the solenoidal magnet, the rate of spin may be controlled independently of the velocity of the projectile. Alternatively, a plurality of solenoidal magnets may be utilized to impart differing spin rates to the projectile at different locations within the barrel.

DETAILED DESCRIPTION OF A PREFERRED EMBODIMENT

Figure 1:
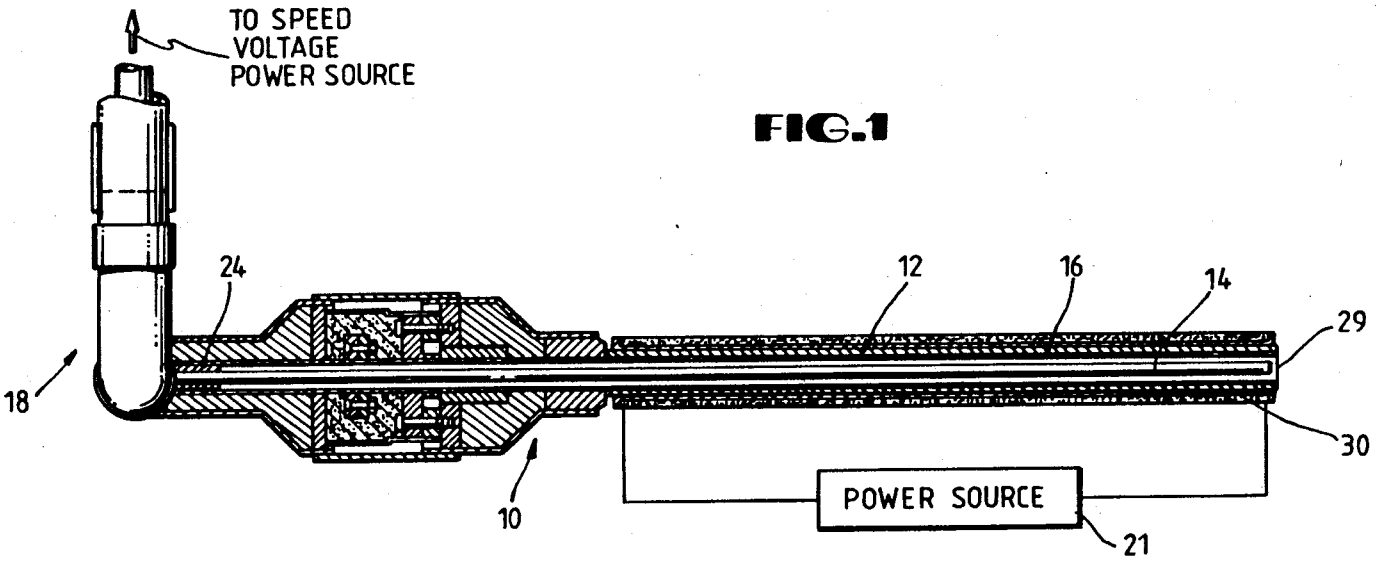
FIG. 1 depicts a railgun in accordance with the present invention, illustrated in schematic representation.

Referring now to FIG. 1, therein is illustrated a railgun 10 in accordance with the present invention, illustrated in schematic representation. Railgun 10 is of a coaxial construction. Railgun 10 includes a barrel assembly 12 including a central coaxial conductor 14 surrounded by an outer coaxial conductor 16. A conventional power coupling mechanism, as known to those skilled in the art, indicated generally at 18, will couple inner and outer coaxial conductors 14, 16 to an appropriate power source (not illustrated), such as, for example, a capacitor bank or a homopolar generator, also as known to those skilled in the art.

Coaxially aligned with barrel 12 is solenoid coil 20. Coil 20 will be utilized to impart a spin to the projectile fired from railgun 10. Coil 20 is illustrated extending along a major portion of barrel 12. As will be apparent from the discussion to follow, this illustrated positioning is illustrative only, as the benefits of the invention may be achieved through placement of the coil proximate a reduced portion of barrel 12 or may be achieved through the use of multiple coils at selected locations along barrel 12. Coil 20 is coupled to an appropriate power source 21 as will be discussed later herein.

Figure 2:
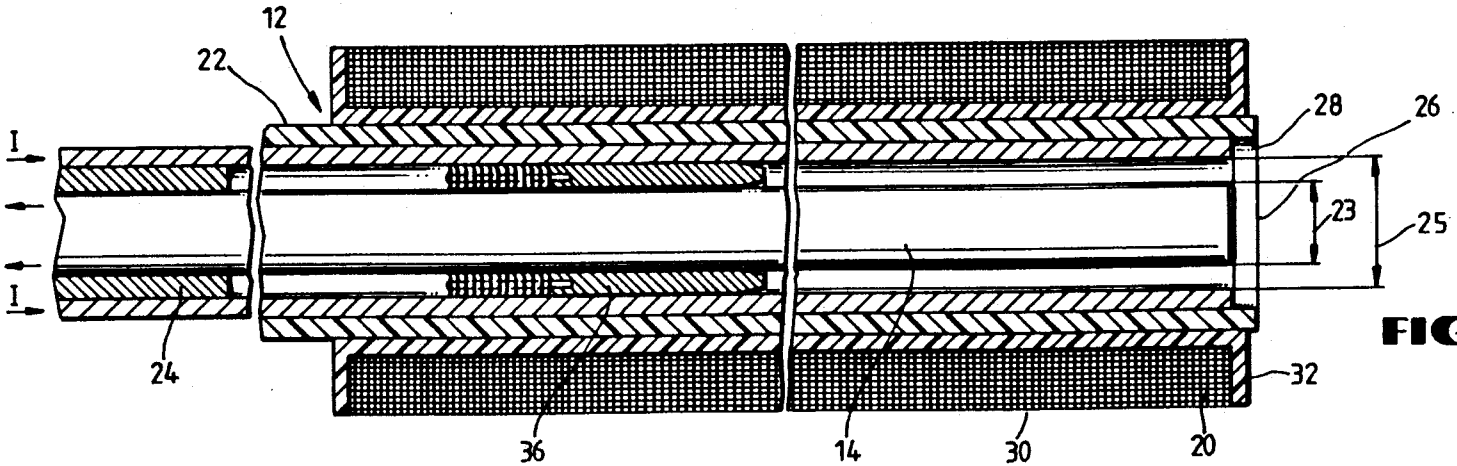
FIG. 2 depicts the barrel of the coaxial railgun of FIG. 1, illustrated in vertical section.

Referring now to FIG. 2, therein is depicted an exemplary embodiment of barrel 12 of coaxial railgun 10, depicted in vertical section. Barrel 12 includes a high strength, non-conductive, nonmagnetic outer tube 22 which supports outer coaxial conductor 16 against the expansive forces established within barrel 12 when a projectile is fired. A high strength ceramic insulator 24 serves to space inner coaxial conductor 14 from outer coaxial conductor 16. In the exemplary embodiment depicted, wherein barrel 12 is approximately three meters in length, the outer diameter 23 of inner coaxial conductor 14 is approximately twenty millimeters, while the inner diameter 25 of outer coaxial conductor 16 is approximately thirty millimeters. The outer ends of both inner conductor 14 and outer conductor 16 are preferably capped with tungsten tips 26 and 28, respectively, to minimize erosion of the conductors due to arc erosion at muzzle 29 of railgun 10. Situated within barrel 12 is one preferred embodiment of a projectile 36 suitable for use with the present invention.

Situated proximate barrel 12 is a solenoidal magnet 20 connected to an appropriate electrical power source 21. Solenoidal magnet 20 is preferably a conventional flat-wound coil 30 on an insulating mandrel 32. Solenoidal magnet 20 can be of a variety of configurations. Solenoidal magnet 20 and its power source 21 will be cooperatively designed to provide an appropriate number of ampere turns to generate the desired magnetic field strength within the path of the projectile. Accordingly, solenoidal magnet 20 may be configured to be energized by any convenient power source. Because of the minimal launch times experienced with the use of coaxial railguns, as will be discussed below, solenoid coil 20 may typically be energized by DC current during the launch period only, without the need for pulsing current through the coil.

Figure 3B:
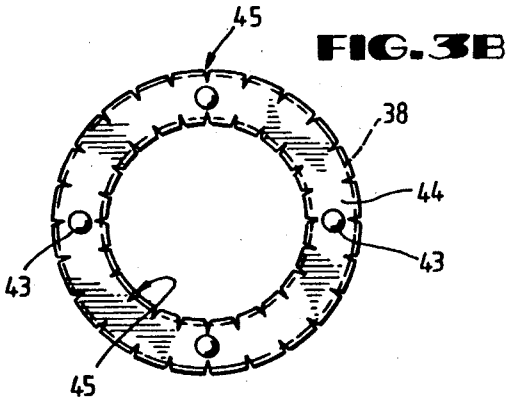
FIG. 3 depicts a projectile for use in the coaxial railgun of FIG. 1, illustrated in FIG. 3A in vertical section along its longitudinal axis, and in FIG. 3B in vertical section along line 3A—A in FIG. 3A.
Figure 3A:
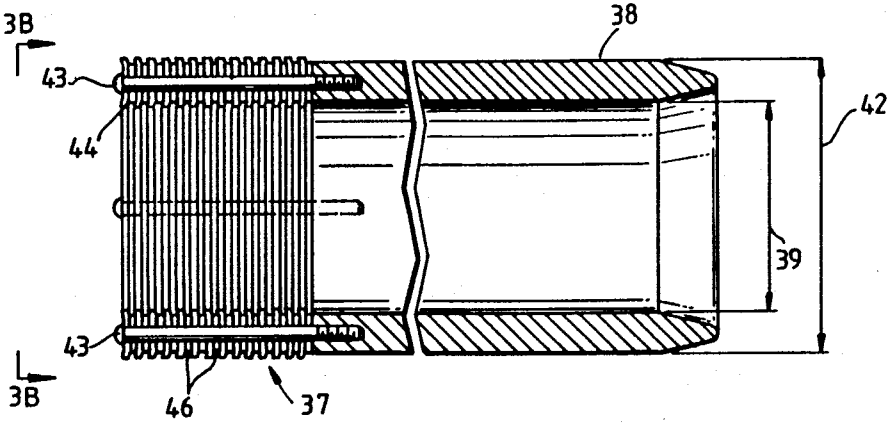

Referring now to FIGS. 3A–B, therein is depicted projectile 36, illustrated in vertical section. Projectile 36 includes a body 38 which is preferably formed of either a ceramic material or of a nonmagnetic metal coated with an electrically insulating coating. Other materials, however, such as Lexan®, may be suitable. In the illustrated exemplary embodiment, projectile body 38 is approximately seventy millimeters long. The inner diameter 39 of projectile body 38 is preferably twenty millimeters so as to closely engage inner conductor 14 of railgun 10. Similarly, outer diameter 42 of projectile body 38 is preferably thirty millimeters, so as to closely engage the inner diameter of outer coaxial conductor 16. Projectile 36 also includes a laminated copper armature, indicated generally at 37.

Armature 37 preferably includes either a plurality of continuous conductive rings 44 or a plurality of conductive elements which are radially situated relative to the axis of projectile 36. In a particularly preferred embodiment, armature 37 includes a stack of conductive rings 44 separated by non-conductive elements 46. Each conductive ring 44 is conformed to contact both inner conductor 14 and outer conductor 16 when projectile 36 is placed within barrel 12 of railgun 10. To accommodate such contact, the inner and outer edges of each conductive ring 44 may include a plurality of radial slits 45 to allow flexibility of such edges. The conductive elements of armature 37 are non-rotatably fixed to body 38 of projectile 36, such as by rivets 43. In this preferred embodiment, projectile 36 will have a weight of approximately 0.240 kilograms.

Referring to FIGS. 1–3, the driving force in a railgun may be determined by the equation:

$$F = \frac{1}{2} L' I^2 = ma \tag{1}$$

here:

F = force in Newtons;

L' = the inductance gradient of the railgun in Henry's/meter;

I = the gun current in amps;

m = the projectile mass in kilograms; and a = acceleration in meters per second$^2$.

The inductance gradient (L') of coaxial railgun 10 may be determined by the equation:

$$L' = \frac{\mu_0}{2\pi} \ln \frac{b}{a} \tag{2}$$

here:

$\mu_0$ = the permeability of free space = $\pi \cdot 10^{-7}$;

b = the inner diameter of the outer electrode (30 millimeters); and a = the outer diameter of the inner electrode (20 millimeters).

L' therefore equals: $0.081 \times 10^{-6}$H/m.

For an ideal railgun, the required drive voltage (37 V") is established by the relationship:

$$V = L'Iv \tag{3}$$

here: v = the velocity of the projectile.

In actuality, some additional voltage will be required to overcome dissipative of losses in the railgun. Such additional voltage, however, should be minimal relative to the speed voltage.

In a first example of the operation of coaxial railgun 10 and projectile 36 as described above, wherein the projectile is fired in response to a peak speed voltage of 243 volts and a gun current of $1 \times 10^6$ amps, the projectile will reach a velocity of approximately 1 kilometer per second with a kinetic energy of 0.12 megajoules.

In a second example, wherein projectile 36 is fired in response to a peak speed voltage of 729 volts and a gun current of $3 \times 10^6$ amps, the projectile will reach a velocity of approximately 3 kilometers per second, with a kinetic energy of 1.1 megajoules. Thus, for a three-fold increase in the gun current, the speed of the projectile will similarly be increased three-fold, but the kinetic energy of the projectile will increase by a factor of 9.

As discussed herein, as the projectile is propelled down barrel 12 of coaxial railgun 10 by the speed voltage applied between conductors 14 and 16, an electrical current passed through solenoid coil 20 will establish a magnetic flux field passing through barrel 18. As projectile 36 passes through the flux field, the conductive armature will be angularly accelerated by the field, causing the projectile to spin.

The torque (T) acting to spin the projectile can be found from the following relationship:

$$T = \frac{IB}{r} \tag{4}$$

here:

B = the applied magnetic field; and r = the average radius of the projectile (12.5 millimeters in this case). The angular acceleration $\alpha$ is found by the relationship:

$$T = J\alpha \tag{5}$$

here:

J = the projectile moment of inertia in kilograms/meter$^2$; and $\alpha$ = angular acceleration of the projectile in radians/second$^2$.

Equating the two relationships, $$T = \frac{IB}{r} = J\alpha \quad (6)$$

or:

$$\alpha = \frac{IB}{Jr} \quad (7)$$

For the first example as set forth earlier herein, with a gun current of $1\times10^6$ amps, the projectile will have a launch time within barrel 18 of 0.018 seconds. The angular velocity of the projectile (w) is established by the relationship:

$$w = \alpha t \quad (8)$$

here:

t = the launch time within the barrel.

Accordingly, the angular of velocity (w) is determined by:

$$w = \frac{IBt}{Jr} \quad (9)$$

Accordingly, for the first example, wherein the gun current is $1\times10^6$ amps and the launch time within barrel 12 is 0.018 seconds, $J = mr^2 = 3.75\times10^{-5}$ kilograms per meter squared; so that for a magnetic field of: B =0.001T, the angular velocity of the projectile will $3.8\times10^7$ radians/second.

For the second example, wherein the gun current is $3\times10^7$ amps and the launch time within barrel 12 is 0.002 seconds, the angular velocity will be $1.3\times10^7$ radians/second. Accordingly, where the magnetic field remains constant, while the gun current, and therefore the projectile speed is increased three fold, the rate of spin will decrease by a factor of three. As is apparent from the proceeding discussion, however, the rate of spin of the projectile may be held constant, or varied as desired, through variance of the magnetic field applied through solenoid coil 20.

For an embodiment as described herein, wherein the projectile has an average radius of 12.5 millimeters and is fired by a coaxial railgun 10 as described herein, the magnetic field may be provided by an energized solenoid coil having 2500 ampere turns. One exemplary construction of such coil would be a 1000 turn coil having a resistance of 200 mΩ energized by 500 mV. Power source 21 will be selected to provide the appropriate power for the individual coil utilized.

Figure 4:
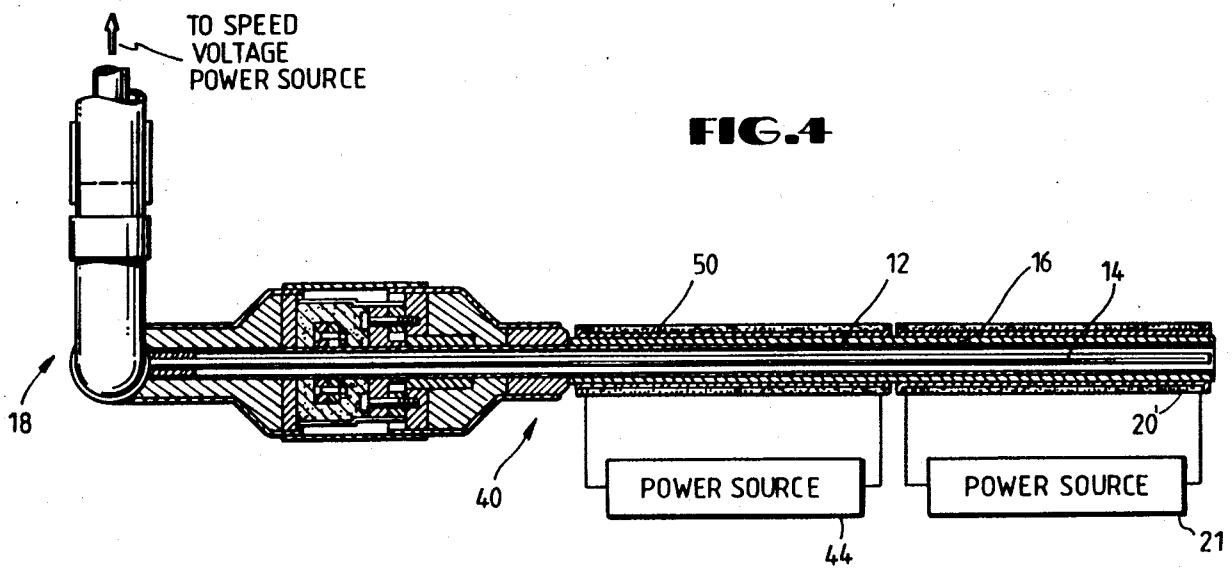
FIG. 4 depicts a railgun in accordance with the present invention which includes a plurality of solenoid magnets situated along the length of the railgun barrel.

Referring now to FIG. 4, as indicated earlier herein, the benefits of the present invention may be achieved through a variety of embodiments. One or more solenoid coils may be situated at any position along barrel 18 at which it is desired to impart a rotation to the projectile. Coaxial railgun 40 depicted in FIG. 4 is identical to coaxial railgun 10 with the exception that first solenoidal coil 20' extends along a lesser portion of barrel 12 relative to coaxial railgun 10 and railgun 40 includes a second solenoidal coil 50 which extends along the remaining portion of barrel 12. In railgun 40, solenoid coils 20' and 50 may be of different field strengths and may be utilized to impart varying rates of spin to the projectile at different locations within barrel 18. Power sources 21 and 44 may thus supply differing power to coils 20' and 50. The varying rates of spin of the projectile may be utilized for purposes other than just stabilizing the projectile in flight. For example, a spin might be utilized to activate a component within the projectile, for example, to arm a fuse in the projectile.

In an alternative embodiment within the scope of the present invention, a spin may be imparted to a projectile without the application of a current to solenoid coil 20. Solenoid coil 20 may be appropriately designed in relation to railgun 10, such that the gun drive current, applied to fire the projectile, will establish eddy currents within the coil which generate a sufficient magnetic field to spin the projectile. In such a method, however, because the magnetic field will be directly tied to the operating current of the railgun, the rate of spin will be a function of the velocity of the projectile within the railgun barrel.

Many modifications and variations may be made in the techniques and structures described and illustrated herein without departing from the scope of the present invention. Accordingly, it should be readily understood that the examples and descriptions given herein are illustrative only and are not to be construed as limitations upon the scope of the present invention.

I claim:

1. A method of inducing a spin in a projectile fired from the barrel of a railgun having a plurality of conductive rails, comprising the steps of:

cooperatively conforming said barrel of said railgun and said projectile such that said projectile is rotatable relative to said conductive rails within at least a portion of said barrel;

establishing a magnetic field coextensive with a portion of the length of said conductive rails of said railgun, said magnetic field for rotating said projectile; and propelling said projectile through said barrel and said magnetic field by passing an electrical current through said projectile.

2. The method of claim 1, wherein said railgun is a coaxial railgun and said projectile is a generally tubular projectile.

3. The method of claim 1, wherein said magnetic field is established by placing a magnet around a portion of said barrel.

4. The method of claim 1, wherein said magnetic field is established by a solenoidal magnet proximate a portion of said barrel.

5. The method of claim 4, wherein said solenoidal magnet is disposed coaxially with a portion of said barrel.

6. An apparatus for establishing a spin in a projectile fired from a railgun wherein said railgun includes a barrel with at least two conductive rails, comprising:

a projectile cooperatively conformed with the barrel of said railgun such that said projectile is rotatable relative to said conductive rails within at least a portion of said barrel, said projectile comprising a conductive element; and means for establishing a magnetic field coextensive with said rails of said railgun barrel to rotate said projectile when said projectile is propelled from said railgun.

7. The apparatus of claim 6, wherein said railgun is a coaxial railgun and said projectile is a generally tubular projectile.

8. The apparatus of claim 6, wherein said projectile includes an armature, said armature comprising a conductive portion.

9. The apparatus of claim 6, wherein said means for establishing a magnetic field comprises a solenoidal magnet.

10. The apparatus of claim 9, wherein said solenoidal magnet is oriented coaxially with a portion of said barrel.

11. An apparatus for inducing a spin in a projectile propelled from the barrel of coaxial railgun comprising:

a projectile having a plurality of conductive elements;

a solenoidal magnet including a coil member situated coaxially with a portion of said barrel; and means for passing an electrical current through the coil of said solenoidal magnet.

12. The apparatus of claim 11, wherein said projectile comprises an armature and said plurality of conductive elements are situated in said armature.

13. A method of inducing a spin in a projectile fired from the barrel of a railgun having a plurality of conductive rails, said projectile having an electrically conductive armature, comprising the steps of:

cooperatively conforming said barrel of said railgun and said projectile such that said projectile is rotatable relative to said conductive rails within at least a portion of said railgun barrel;

establishing a first electromagnetic field adapted to propel said projectile along said conductive rails, said first electromagnetic field established by applying an electrical current through at least two of said conductive rails and through said armature of said projectile;

establishing a second electromagnetic field coextensive with at least a portion of said conductive rails of said railgun, said second electromagnetic field adapted to cooperate with said electrical current applied in said armature of said projectile to rotate said projectile relative to said conductive rails.

14. The method of claim 13, wherein said railgun is a coaxial railgun, and wherein said projectile is a generally tubular projectile.

15. The method of claim 13, wherein said second electromagnetic field is established by placing a magnet around a portion of said barrel and generally coextensive with said conductive rails.

16. The method of claim 13, wherein said second electromagnetic field is established by a solenoidal magnet proximate a portion of said barrel.

17. The method of claim 16, wherein said solenoidal magnet is disposed generally coaxially and generally coextensively with a portion of said barrel.

18. A method of establishing a spin in a projectile fired from a railgun having coaxial rails, comprising the steps of:

forming said projectile with a conductive element configured to extend generally between said coaxial rails of said railgun;

propelling said projectile along said coaxial rails of said railgun by passing an electrical current through said conductive element of said projectile to establish a first magnetic field; and establishing a second magnetic field through which said projectile will pass when said projectile is propelled along said coaxial rails, said second magnetic field adapted to cooperate with said electrical current passing through said conductive element of said projectile to cause rotation of said projectile relative to said coaxial rails.

19. The method of claim 18, wherein said second magnetic field is established by placing a conductive coil generally coextensively with a portion of said coaxial rails.

20. The method of claim 19, wherein said second magnetic field is further established by passing an electrical current through said conductive coil.

21. The method of claim 18, wherein said projectile includes an armature and wherein said conductive element is located in the armature of said projectile.

22. The method of claim 18, wherein said projectile includes an armature having a plurality of conductive elements.

23. An apparatus for establishing a spin in a projectile fired from a railgun, wherein said railgun includes a barrel with at least two conductive rails, comprising:

a projectile cooperatively conformed with the barrel of said railgun such that said projectile is rotatable relative to said conductive rails within at least a portion of the length of said conductive rails, said projectile comprising a conductive element; and means for establishing a magnetic field coextensive with said rails to rotate said projectile relative to at least said portion of said conductive rails when said projectile is propelled from said railgun.

24. The apparatus of claim 23, wherein said railgun is a coaxial railgun and wherein said projectile is a generally tubular projectile.

25. The apparatus of claim 23, wherein said projectile includes an armature, said armature comprising a conductive portion.

26. The apparatus of claim 23, wherein said means for establishing said magnetic field comprises a solenoidal magnet located generally coaxially with at least a portion of said conductive rails.

27. An apparatus for inducing a spin in a projectile propelled from the barrel of a coaxial railgun, said coaxial railgun having a plurality of conductive rails, comprising:

a projectile having a conductive element through which a current will be passed between said conductive rails to propel said projectile within said railgun; and a solenoidal magnet located generally coaxially and being generally coextensive with at least a portion of said conductive rails, said solenoidal magnet sized and configured to generate a magnetic field which will cooperate with said conductive element of said projectile as said projectile is propelled in said railgun to generate a spin in said projectile to cause said projectile to rotate relative to said conductive rails of said railgun.

28. The apparatus of claim 27, further comprising means for passing an electrical current through the coil of said solenoidal magnet.

29. The apparatus of claim 27, wherein said projectile includes a plurality of conductive elements.

30. The apparatus of claim 29, wherein said projectile includes an armature, and wherein said plurality of conductive elements are situated in said armature.

31. The apparatus of claim 27, wherein said apparatus comprises a plurality of solenoidal magnets situated generally coaxially and coextensively with a portion of said barrel of said railgun.

* * * * *

UNITED STATES PATENT AND TRADEMARK OFFICE

CERTIFICATE OF CORRECTION

PATENT NO. : 5,189,244

DATED : February 23, 1993

INVENTOR(S) : William F. Weldon

It is certified that error appears in the above-indentified patent and that said Letters Patent is hereby corrected as shown below:

In column 3, line 63, "here:" should read --where:--.

In column 4, line 9, "here:" should read --where:--

In column 4, line 16, please delete "37".

In column 4, line 17, V") should read "V").

In column 4, line 21, "here:" should read --where:--

In column 4, line 55, "here:" should read --where:--

In column 5, line 17, "here:" should read --where:--

In column 5, line 29, before 3.8, please add --be--.

Signed and Sealed this

Fourth Day of January, 1994

*Attest:*

*Attesting Officer*

BRUCE LEHMAN

*Commissioner of Patents and Trademarks*